US005320922A

United States Patent [19]

Mayama et al.

[11] Patent Number: 5,320,922

[45] Date of Patent: Jun. 14, 1994

[54] ELECTROPHOTOGRAPHIC PHOTOSENSITIVE MEMBER AND APPARATUS USING SAME

[75] Inventors: Shinya Mayama, Kanagawa; Kiyoshi Sakai, Tokyo, both of Japan

[73] Assignee: Canon Kabushiki Kaisha, Tokyo, Japan

[21] Appl. No.: 945,379

[22] Filed: Sep. 16, 1992

[30] Foreign Application Priority Data

Sep. 19, 1991 [JP] Japan ..... 3-239685

[51] Int. Cl.[5] ..... G03G 5/14

[52] U.S. Cl. ..... 430/63

[58] Field of Search ..... 430/63, 65

[56] References Cited

U.S. PATENT DOCUMENTS

| | | | |
|---|---|---|---|
| 4,399,208 | 8/1983 | Takasu et al. | 430/59 |
| 4,487,824 | 12/1984 | Katagiri et al. | 430/58 |
| 4,501,808 | 2/1985 | Sakai et al. | 430/59 |
| 4,663,259 | 5/1987 | Fujimura et al. | 430/58 |
| 4,920,022 | 4/1990 | Sakakibara et al. | 430/59 |
| 4,946,766 | 8/1990 | Fukagai | 430/60 |
| 5,079,117 | 1/1992 | Koyama et al. | 430/58 |
| 5,190,837 | 3/1993 | Sakai et al. | 430/63 |

FOREIGN PATENT DOCUMENTS

| | | | |
|---|---|---|---|
| 52-7242 | 1/1977 | Japan . | |
| 1-233458 | 9/1989 | Japan . | |
| 61-163346 | 7/1990 | Japan . | |
| 3-136062 | 6/1991 | Japan . | |
| 3-136063 | 6/1991 | Japan . | |
| 3-136064 | 6/1991 | Japan . | |
| 2-75365 | 11/1981 | United Kingdom | 430/63 |

OTHER PUBLICATIONS

"alloy", Hackh's Chemical Dictionary, pp. 28–29 (1972).

*Primary Examiner*—Christopher Rodee

*Attorney, Agent, or Firm*—Fitzpatrick, Cella, Harper & Scinto

[57] ABSTRACT

An electrophotographic photosensitive medium has a photosensitive layer on an electroconductive base, the medium having at least one intermediate layer between the base and the photosensitive layer, the intermediate layer containing indium oxide - tin oxide solid solution (ITO) powder and a binder resin. An electrophotographic apparatus includes a photosensitive medium; a device for forming latent images; a device for developing formed latent images; and a device for transferring developed images to a transfer member.

7 Claims, 2 Drawing Sheets

ELECTROPHOTOGRAPHIC PHOTOSENSITIVE MEMBER AND APPARATUS USING SAME

BACKGROUND OF THE INVENTION

1. Field of the Invention

The present invention relates to an electrophotographic photosensitive member and, more particularly, to an electrophotographic photosensitive member with excellent potential characteristics, having an electroconductive intermediate layer capable of reducing black spot fogging in images at high temperature and humidity.

2. Description of the Related Art

An electrophotographic photosensitive member is basically formed of a base and photosensitive layers. However, when the base is an insulating material, such as paper or plastic, an electroconductive film must be provided on the base in order to cause electrical charge to flow. When the base is a metal, such as aluminum, copper, brass, or stainless steel, an electroconductive film need not be formed on the base, but forming such a electroconductive film is effective for increasing the coating ability of the photosensitive member, protecting the photosensitive member against electrical breakdown, covering defects on the surface of the base, and the like. It is required that the coated layer have a sufficiently low electrical resistance such that it prevents electrical charges from being accumulated when it is used repeatedly in a high-speed electrophotographic process and that it provides stable potential characteristics.

Since it has been difficult in the past to obtain an electroconductive film described above by using only a single resin, usually the film is formed by dispersing electroconductive powder in a binder resin. As disclosed in, for example, Japanese Patent Laid-Open No. 61-163346, metallic powder, such as nickel, copper, silver, or aluminum; metallic oxide powder, such as iron oxide, tin oxide, antimony oxide, or indium oxide, or a mixture of these; carbon black; fibrous carbon, or the like, are used for such electroconductive powder.

An electrophotographic photosensitive member having a vapor deposition film containing indium oxide in which tin or tin oxide, or a mixture of both, are doped, is disclosed in Japanese Patent Laid-Open No. 52-7242.

However, the above-described electroconductive powder has certain drawbacks. Metallic powder, such as nickel, copper, silver, or aluminum, has sufficient electroconductivity. However, since it is comparatively easy to oxidize, the potential characteristics thereof are readily changed when it is used continuously at a high temperature and high humidity Accordingly, image defects, such as spot fog, is likely to occur. Also, electroconductive powder, such as electroconductive iron oxide, tin oxide, antimony oxide, titanium oxide, or a mixture of these has a comparatively high work function If the resistance thereof is sufficiently decreased so that residual potential is not accumulated because of repeated use at low temperature and low humidity, satisfactory potential characteristics can be obtained. On the other hand, at high temperature and high humidity, there is a drawback in that spot fog occurs It is known that indium oxide has a low work function and is highly stable even in an oxide atmosphere or a reducing atmosphere. This fact is disclosed in, for example, Japanese Patent Laid-Open Nos. 1-233458, 3-136064, 3-136063, and 3-136062. However, indium oxide powder has a drawback in that its resistance is high. Accordingly, characteristics required for a photosensitive member; i.e., sensitivity, residual potential and repeatability under different environmental conditions, cannot be satisfied unless a considerably increased amount is employed in order to form a practical photosensitive drum. Also, the resistance of a vapor deposition film containing indium oxide in which tin or tin oxide, or a mixture of both of these, are doped, is low. For this reason, a vapor deposition film of indium oxide in which tin, tin oxide or a mixture is doped, cannot sufficiently prevent charge injection, and it is difficult to reduce spot fogs.

SUMMARY OF THE INVENTION

It is an object of the present invention to provide an electrophotographic photosensitive member, by which the problems of a conventional electroconductive intermediate layer are solved, having satisfactory electrical potential characteristics and stable repeatability under environments from high temperature and high humidity to low temperature and low humidity, and having excellent image characteristics, wherein the image is capable of being stably stored.

It is another object of the present invention to provide an electrophotographic apparatus which uses such an electrophotographic photosensitive member.

To these ends, according to the present invention, there is provided an electrophotographic photosensitive member having a photosensitive layer on an electroconductive base, having at least one intermediate layer between the base and the photosensitive layer, the intermediate layer containing indium oxide - tin oxide solid solution (ITO) powder.

Electroconductive ITO powder is formed mechanically by mixing the powders of indium oxide and tin oxide. Electroconductive ITO solid solution powder is manufactured by dissolving indium and tin in, for example, an acid, coprecipitating the above two ingredients and thereafter calcining them.

The electrical characteristics of the ITO powder formed by the above two types of manufacturing methods can be controlled by varying the indium/tin ratio. In the mechanically mixed ITO powder, sometimes both compounds separate into tin oxide and indium oxide while it is being dispersed in the binding agent resin Thus, it is quite difficult to control the resistance of the electroconductive intermediate layer. In contrast, since the indium and tin ions in the ITO solid solution powder have comparatively similar ion radii, indium ions are replaced with tin ions in the crystal lattices Therefore, neither compound separates, and charge carriers occur uniformly and high stable resistance is shown.

According to the present invention, the electrophotographic photosensitive member having a photosensitive layer on an electroconductive base, has at least one intermediate layer between the base and the photosensitive layer, this layer containing the above-mentioned indium oxide - tin oxide solid solution (ITO) powder and a binder resin. As a result, the present invention provides an electrophotographic photosensitive member having excellent potential characteristics and stable repeatability in environments from high temperature and high humidity to low temperature and low humidity and excellent image characteristics, wherein the image is capable of being stably stored.

Other objectives, features, and advantages in addition to those discussed above will become more apparent from the following detailed description of the preferred embodiments considered in conjunction with the accompanying drawings

DESCRIPTION OF THE PREFERRED EMBODIMENTS

Figure 1:
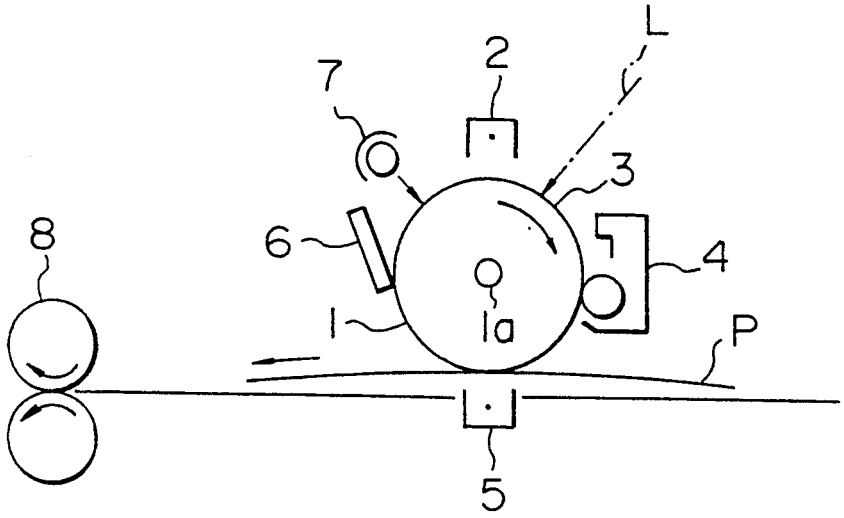
FIG. 1 is a schematic view of a commonly-used transfer type electrophotographic apparatus which uses an electrophotographic photosensitive member according to the present invention.

The indium oxide to tin oxide ratio of such electroconductive ITO solid solution powder is determined by taking the resistance value, color tone or the like of the desired powder into consideration. The desired composition ratio of indium oxide to tin oxide in terms of wt % is preferably between 70% to 99.5%. The content of tin oxide is preferably 0.5% or more from the viewpoint of forming the powder with low resistance.

During exposure, if light is reflected on the surface of the base, when an image is exposed with red light from a semiconductor laser, an LED or the like, then something which is similar to sensitization is likely to occur. Accordingly, it is preferable that the content of tin oxide be 70% or less to suppress the absorption of red light by the electroconductive intermediate layer, so that the electroconductive intermediate layer does not become excessively bluish gray.

The resistivity of such ITO solid solution powder should preferably be less than 1,000Ω. If above 1,000 ohms, then the characteristics required for an electrophotographic photosensitive member, i.e., sensitivity, residual potential, repeat characteristics, or the like, deteriorate. Consequently, even if more powder is added, these characteristics cannot be satisfied.

In the intermediate layer of the present invention, the ITO solid solution powder is dispersed in the binder resin. When the electroconductive intermediate layer of the present invention is formed with a binder resin, the ITO powder ratio should preferably be in the range of 33 wt % to 80 wt % and from 50 wt % to 75 wt % from the point of view of film forming ability. The amount to be added should preferably be 33 wt % or more from the viewpoint of electroconductivity. The resistivity value of the electroconductive intermediate layer in an electric field intensity $10^5$ V/m should preferably be $10^{10}$ Ω to $10^5$ Ω to the extent that it is applied to the electroconductive intermediate layer when it is used as an electrophotographic photosensitive member.

In addition to the ITO solid solution powder, other electroconductive powders, for example, white electroconductive powder, such as titanium oxide, or very small spherical bodies containing polydimethylsiloxane as main constituents used to suppress the coherent scattering of laser beams, or a surface roughening agent, may be introduced to the electroconductive intermediate layer of the present invention in order to increase the optical shielding power of the base. Either a thermoplastic resin or a hardenable resin may be used as a binder resin for the electroconductive intermediate layer of the present invention. Specifically, the following are examples of such a thermoplastic resin: polymethyl methacrylate, polystyrene, an acrylic resin of a styrene-acrylic copolymer or the like, a phenol novolak resin, cresol novolak resin, a methacresol novolak resin, low molecular weight polypropylene, styrene-butadiene rubber, ethylene-vinyl acetate copolymer, vinyl chloride, vinyl acetate, polyvinyl alcohol, polyvinyl acetal, polyvinyl pyrrolidone, petroleum resin, cellulose, cellulose acetate, cellulose nitrate, methylcellulose, hydroxymethylcellulose, cellulose derivatives of hydroxypropylcellulose or the like, a saturated alkyl-polyester resin, a polyethylene terephthalate resin, polybutylene terephthalate resin, an aromatic polyester resin of a polyallylate resin or the like, 6-nylon, 11-nylon, 6-1-nylon, 8-nylon, methoxymethylated 8-nylon, nylon4, 6 or the like, polyester amide resin, polyacetal, polycarbonate, polyether sulfone, polysulfone, polyphenylene sulfide, and polyether ether ketone.

The following are examples of such a hardenable or curable resin: phenol resin, modified phenol resin, maleic resin, alkyd resin, epoxy resin, acrylic resin, unsaturated polyester resin obtained by polycondensing, for example, maleic anhydride-terephthalic acid-polyhydric alcohol, urea resin, melamine resin, urea-melamine resin, xylene resin, toluene resin, guanamine resin, melamine-guanamine resin, benzoguanamine resin, acetoguanamine resin, glyptal resin, furan resin, silicone resin, polyimide resin, polyamide imide resin, and polyether imido resin.

Another specific example of hardenable resins is a cured compound obtained by mixing polyester acrylate, epoxy acrylate, melamine acrylate, alkyd acrylate, or silicon acrylate with a preferred photopolymerization initiator and a proper polyfunctional acrylate and by photopolymerizing them.

A leveling agent, such as silicone oil, silicone macromer copolymer, or a fluorine type surfactant, may be added to the electroconductive intermediate layer of the present invention for increasing the smoothness and coating ability of the films.

The electroconductive intermediate layer can be used preferably in the parameters in which various electrophotographic characteristics are not reduced. The preferred thickness of such an electroconductive intermediate layer is usually from 3 μm to 30 μm. When resistance against charge implantation in an environment, in particular, at high temperatures and high humidity, sensitivity and residual potential are taken into consideration, the preferred thickness of the intermediate layer is from 5 μm to 25 μm.

The electroconductive intermediate layer of the present invention is used as an undercoat layer of the electrophotographic photosensitive member. Electroconductive materials, for example, aluminum, an aluminum alloy, copper, zinc, stainless steel, vanadium, molybdenum, chromium, titanium, nickel, indium, gold, palladium or the like may be used for electroconductive bases in the present invention. A base whose surface is electroconductively processed may also be used, such as plastics having electroconductive layers obtained by depositing aluminum, an aluminum alloy, indium oxide, tin oxide, ITO or the like in a vacuum.

In the present invention, an electroconductive intermediate layer is provided between the electroconductive base and the photosensitive layer. The intermediate layer may be formed of a single layer or two or more layers When it is used as a single layer, it is used as it is. However, when used in combination with a second intermediate layer, that second intermediate layer preferably has a resin compound with ionic conductivity for controlling resistance.

That second intermediate layer may be formed from casein, polyvinyl alcohol, nitrocellulose, ethylene-acrylic copolymer, polyvinyl butyral, phenol resin, polyamide resins (nylon 6, nylon 66, nylon 610, copolymer nylon, alkoxyl methylated nylon or the like), polyurethane, gelatin, aluminum oxide or the like. The thickness of the second intermediate layer should be 0.1 μm to 10 μm and preferably 0.3 μm to 5 μm.

The photosensitive layer may be a single layer or a laminate of layers, such as a dual function laminate of a charge generation layer and charge transfer layer. In a single layer embodiment a photoconductive material or a mixture of charge generating and charge transfer materials may be employed together with suitable binder(s).

The charge generation layer of the present invention is obtained by dispersing charge generating pigments in various binder resins Specific examples of such pigments used for the charge generation layer include: azo pigments, such as Sudan Red or Dian Blue, quinone pigments, such as pyrene quinone or anthantrone, quinocyanine pigments, perylene pigments, indigo pigments of indigo, thioindigo or the like, azulenium salt pigments, copper phthalocyanine pigments containing various crystal systems, and titanyl phthalocyanine pigments. Electroconductive ITO solid solution powder is very effective for titanyl phthalocyanine in which fogs are liable to occur. Charge generation layers formed from an inorganic material such as selenium-arsenic or amorphous silicon may also be used. The thickness of such charge generation layers should be less than 5 μm and preferably in a range of 0.05 μm to 2 μm. Such charge generation layers are formed by fully dispersing charge generating materials together with a binder resin and a solvent by means of homogenizers, ultrasonic waves, ball mills, vibration ball mills, sand mills, attritors, roll mills, paint shakers or the like, and applying and drying them. At this stage, the ratio of the charge generating materials to the binder resin should be 1:5 to 5:1 and preferably 1:2 to 3:1.

The charge transfer layer on the charge generation layer is formed from a charge transfer agent and a binder resin. Examples of such charge transfer materials are: polycyclic aromatic compounds, such as biphenylene, anthracene, pyrene or phenanthrene; nitrogen containing polycyclic compounds, such as indole, carbazole, oxadiazole or pyrazoline; hydrazone compounds, and styryl compounds.

The charge transfer layer is formed by dispersing or dissolving the above-mentioned charge transfer materials in a binder resin. Specific examples of such resins are: an acrylic resin of polymethyl methacrylate, styrene-acrylic copolymer or the like, polystyrene, low molecular weight polypropylene, styrene-butadiene rubber, ethylene-vinyl acetate copolymer, vinyl chloride, vinyl acetate, and a copolymer of these, aromatic polyester resins, such as petroleum resin, saturated alkyl polyester resin, polyethylene terephthalate resin, polybutylene terephthalate resin, polyarylate resin, polyacetal, polycarbonate, polyether sulfone, polysulfone, polyphenylene sulfide, and polyether ether ketone. Such a charge transfer material and a binder resin are dissolved or dispersed in a preferred solvent, and thereafter are applied and formed as a charge transfer layer having a thickness of 5 μm to 40 μm and preferably 10 μm to 30 μm.

The charge transfer layer is formed by dissolving the above charge transfer materials and a binder resin in a solvent, and applying them. The mixture ratio of the charge transfer layer and the binder resin should be 3:1 to 1:3, and preferably, 2:1 to 1:2. Examples of a typical solvent are an aromatic hydrocarbon, such as toluene, xylene or monochlorobenzene, and a cyclic ether, and, more specifically, tetrahydrofuran, tetrahydropyran, 1,4-dioxane, as well as halogenated hydrocarbon and ketone compounds. Specific known examples of coating the charge transfer material include an immersion coating method, a spraying coating method, a roll coating method and a gravure coating method. Any method capable of efficiently manufacturing desired photosensitive members should preferably be used.

After the charge transfer layer is coated and formed, the layer is ventilated and dried at a temperature between 10° C. and 200° C., preferably between 20° C. and 150° C. for five minutes to five hours, preferably for 10 minutes to two hours. Thus, the charge transfer layer is formed.

The electrophotographic photosensitive member of the present invention can be applied to, in general, electrophotographic apparatuses, such as copiers, laser printers, LED printers, or liquid-crystal shutter type printers. Further, it can be broadly applied to display devices, recording apparatuses, light printing apparatuses, process facsimile apparatuses, and the like, in which electrophotographic technology is applied.

FIG. 1 schematically shows the construction of a commonly used transfer type electrophotographic apparatus using a photosensitive member of the present invention.

In FIG. 1, reference numeral 1 denotes a drum photosensitive member serving as an image carrier, which is rotated at a predetermined peripheral speed in the direction of the arrow about an axis 1*a*. The peripheral surface of the photosensitive member 1 is uniformly charged at a predetermined positive or negative potential by charging means 2 while the photosensitive member 1 is being rotated. Then, the surface is subjected to optical image exposure L (slit exposure, laser beam scanning exposure or the like) by an image exposure means (not illustrated) in an exposure section 3. As a consequence, an electrostatic latent image is sequentially formed on the peripheral surface of the photosensitive member 1.

Next, the electrostatic latent image is toner developed by developing means 4. The toner developed image is sequentially transferred to the surface of a transfer member P which is fed in synchronization with the rotation of the photosensitive member 1 by transferring means 5 from an paper feed section (not shown) to the section between the photosensitive member 1 and the transferring means 5. The transfer member P to which an image is transferred is separated from the surface of the photosensitive member 1 and introduced to image fixing means 8. The image is fixed by the image fixing means 8 and printed out as a copy.

The toner remaining on the surface of the photosensitive member 1 after the image is transferred is removed and cleaned by cleaning means 6. Furthermore, the charge thereon is removed by the exposure means 7 so that the photosensitive member 1 can be used repeatedly to form images.

A corona charger is widely used as means 2 for uniformly charging the photosensitive member 1. Also, a corona transferring means is widely used as the transferring apparatus 5. A plurality of components from among the components of the above-mentioned photosensitive member, the development means, the cleaning means and the like may be connected into one integrated piece as an electrophotographic unit so that this unit is releasably formed with respect to the main body of the electrophotographic apparatus. For example, at least any one of the charging means, the developing means and the cleaning means may be unified integrally with the photosensitive member to form a unit. This single unit is releasable from the main body of the apparatus. The unit may be released by using guiding means, such as the rails in the main body of the apparatus. At this stage, the unit may be formed with charging means and/or developing means.

When the electrophotographic apparatus is used as a 5 copier or a printer, the optical image exposure L is performed by scanning with laser beams, driving an LED array or driving a liquid-crystal shutter array, by light reflected from a manuscript, light emerging therefrom, or signals formed by reading the manuscript.

When the electrophotographic apparatus is used as a printer of a facsimile machine, the optical image exposure L becomes exposure for printing received data.

Figure 2:
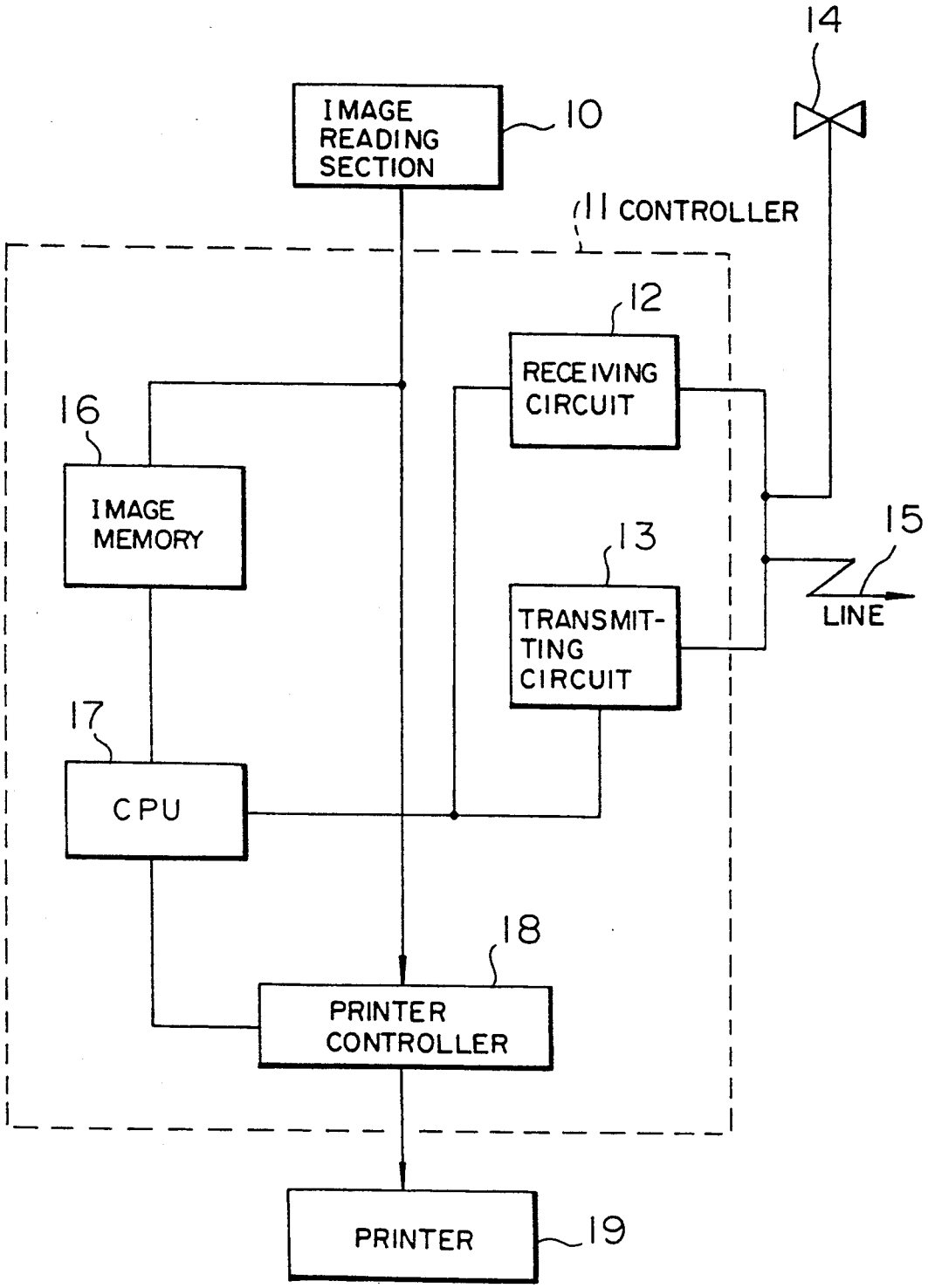
FIG. 2 is a block diagram of a facsimile employing the electrophotographic apparatus shown in FIG. 1 as a printer.

FIG. 2 shows an example of this embodiment in a block diagram.

A controller 11 controls an image reading section 10 and a printer 19. The entire controller 11 is controlled by a CPU 17. Data read by the image reading section 10 is transmitted to a receiving station through a transmitting circuit 13. The data received from the transmitting station is sent to the printer 19 through a receiving circuit 12. Predetermined image data is stored in an image memory. A printer controller 18 controls the printer 19 Reference numeral 14 denotes a telephone set.

Images (image information from a remote terminal connected via the line) received from a line 5 are demodulated by a receiving circuit 12. Thereafter, the CPU 17 decodes the image information and this information is stored sequentially in the image memory 16. When at least one page of images are stored, the images of that page are recorded The CPU 17 reads out one page of image information from the memory 16 and sends out one page of decoded image information to the printer controller 18. Upon reception of one page of image information from the CPU 17, the printer controller 18 controls the printer 19 in order to record the image information of that page. The CPU 17 receives data for the next page while the printer 19 is recording. Images are received and recorded in the abovedescribed way.

The present invention will be explained below in detail with reference to the embodiments. The Examples presented hereafter are meant to illustrate certain preferred embodiments and are not limitative of scope.

The electroconductive intermediate layer of the present invention can be used not only for a function separation type negatively charged photosensitive member shown as an example in detail in this specification but also for a positively charged photosensitive member of a reverse layer or a single layer, or a negatively charged photosensitive member of a single layer. Moreover, it can be used as an electroconductive intermediate layer regardless of the polarity of the photosensitive member or the structure of the layer.

EXAMPLE 1

50 parts (weight parts, and the same applies hereinafter) of ITO solid solution powder (resistivity: 20 to 50 Ωcm) having a composition ratio of 95 wt % indium oxide to 5 wt % tin oxide, 25 parts of a phenol resin, 20 parts of methylcellosolve, 5 parts of methanol, and 0.002 parts of silicone oil (a polydimethyl siloxane polyoxyalkylene copolymer, average molecular weight: 3,000) were dispersed in a paint shaker for 24 hours by using glass beads of 1 mm. Thus, paint for electroconductive layers was obtained. This paint was applied onto an aluminum sheet, and dried at 140° C. for 30 minutes, thus forming an electroconductive layer having a thickness of 10 μm. Next, 5 parts N-methoxy methylated nylon was dissolved in 95 parts methanol, thus forming a resistance control layer. This paint was applied onto the aforesaid aluminum sheet and dried at 100° C. for 20 minutes, thus forming an undercoat layer having a thickness of 0.8 μm for controlling resistance.

Next, 2 parts of polyvinyl benzal (benzalation rate 80%, weight-average molecular weight: 11,000), 35 parts of cyclohexanone and 3 parts of an azo pigment, represented by the structural formula (I) shown below, employed as charge generating materials, were dispersed for 12 hours by means
a sand mill by using glass beads of 1 mm:

(I)

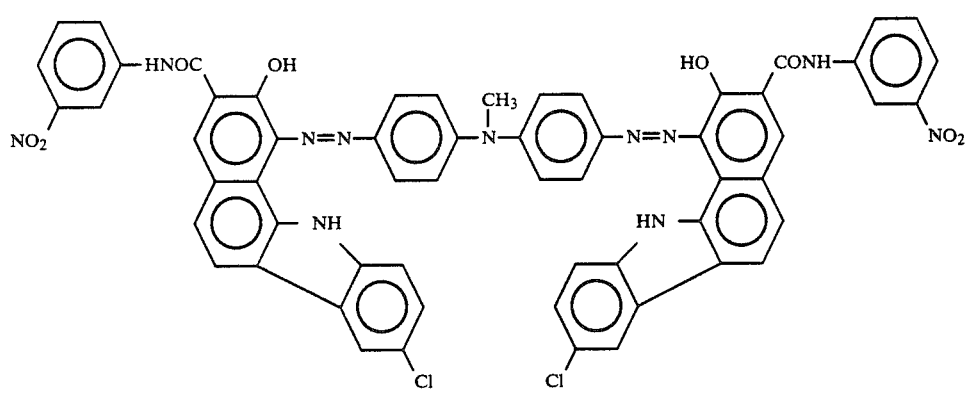

Thereafter, 60 parts of methyl ether ketone were added thereto and diluted, thus forming an application solution for a charge generation layer. This dispersion solution is applied onto the aforesaid intermediate layer and dried at 80° C. for 20 minutes, thus forming a charge generation layer having a thickness of 0.2 μm.

Next, 10 parts of polycarbonate Z resin (viscosityaverage molecular weight: 20,000) and 10 parts of a hydrazone compound, expressed by the structural formula (II) shown below and employed as charge transfer materials, were dissolved in a mixed solvent of 60 parts of monochlorobenzene. This solution was applied onto the above-mentioned charge generation layer and dried at 120° C. for 60 minutes. Thus, a charge transfer layer having a thickness of 20 μm was formed.

(II)

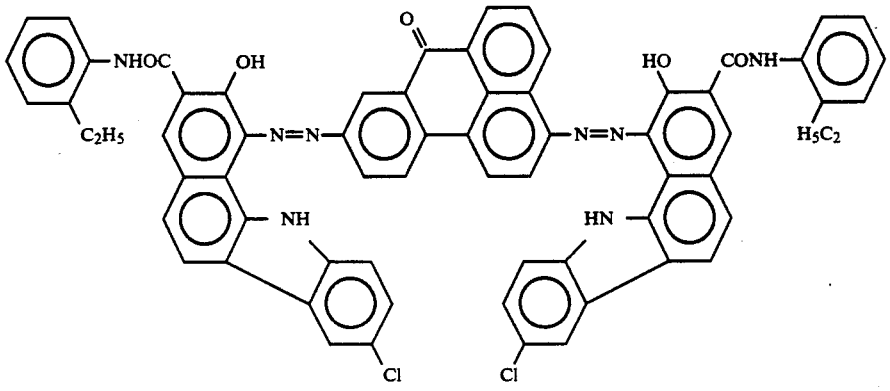

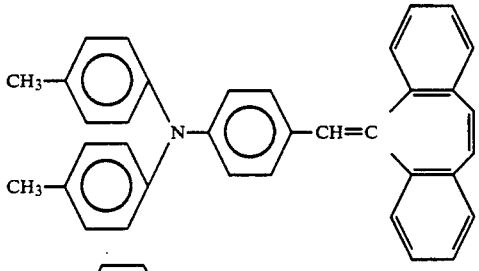

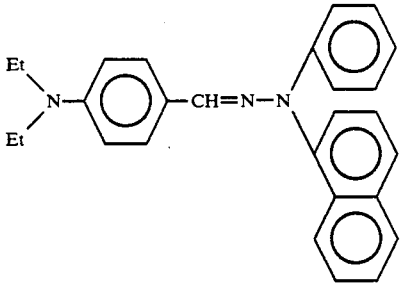

The electrophotographic characteristics of the photosensitive member 1 manufactured in this way were evaluated by measuring optical discharge characteristics by using electroconductive glass of 10 $cm^2$. The results are shown in Table 1.

EXAMPLE 2

A photosensitive member was manufactured in the same way as in Example 1 except that an azo pigment having the structural formula shown below was used as the charge generator of the first embodiment and a styryl compound having the structural formula shown below was used as the charge transfer agent. The characteristics of the photosensitive member were evaluated. The results are shown in Table 1.

EXAMPLE 3

A photosensitive member was prepared in the same way as in Example 1 except that the resistance control layer explained in Example 1 was not provided. The electrophotographic characteristics thereof were evaluated by the method explained in Example 1. The results are shown in Table 1.

EXAMPLE 4

A photosensitive member was prepared in the same way as in Example 1 except that the compound having the structural formula shown below was used as the charge generator of Example 1. The characteristics thereof were evaluated. The results are shown in Table 1.

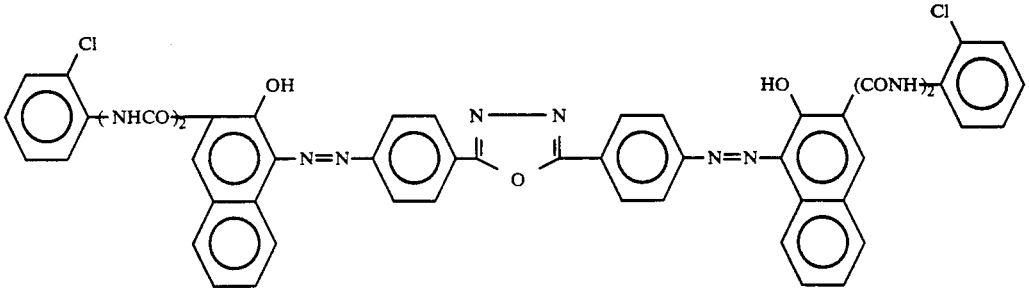

EXAMPLE 5

A photosensitive member was prepared in the same way as in Example 4 except that a styryl compound having the structural formula shown below was used as the charge transfer agent of Example 4. The characteristics thereof were evaluated. The results are shown in Table 1.

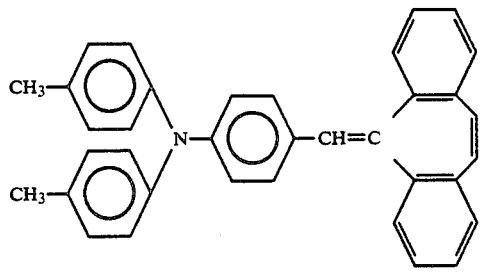

EXAMPLE 6

A photosensitive member was prepared in the same way as in Example 4 except that the resistance control layer explained in Example 1 was not provided. The electrophotographic characteristics thereof were evaluated by the method explained in Example 1. The results are shown in Table 1.

EXAMPLE 7

A photosensitive member was prepared in the same way as in Example 1 except that a titanyl oxyphthalocyanine pigment having a main diffraction peak at 26.3° was used as the charge generator. The electrophotographic characteristics thereof were evaluated. The results are shown in Table 1.

EXAMPLE 8

50 parts of ITO solid solution powder (specific surface area: 20 to 40 $m^2/g$, resistivity: 20 to 50 Ωcm) having a composition ratio of 95 wt % indium oxide to 5 wt % tin oxide, 25 parts of a phenol resin, 20 parts of methylcellosolve, 5 parts of methanol, and 0.002 parts of silicone oil (a polydimethyl siloxane polyoxyalkylene copolymer, average molecular weight: 3,000) were dispersed in a paint shaker for 24 hours by using glass beads of 1 mm. Thus, paint for an electroconductive layer was obtained. This paint was dipped and applied onto an aluminum cylinder of 30 mm and dried at 140° C. for 30 minutes. Thus, an electroconductive layer having a thickness of 10 μm was formed. Next, 5 parts of N-methoxy methylated nylon were dissolved in 95 parts of methanol, thus forming a resistance control layer. The paint was then dipped and applied onto the aforesaid aluminum cylinder and dried at 100° C. for 20 minutes, thus forming an undercoat layer having a thickness of 0.8 μm for controlling resistance.

Next, 3 parts of a titanyl oxyphthalocyanine pigment having a main diffraction peak at 26.3°, 2 parts of polyvinyl benzal (benzalation rate 80%, weight-average molecular weight: 11,000), and 35 parts of cyclohexanone employed as charge generating materials were dispersed for 12 hours by means of a sand mill by using glass beads of 1 mm. Thereafter, 60 parts of methyl ether ketone were added to the above and diluted, thus forming an application solution for a charge generation layer. This dispersion solution was applied onto the aforesaid intermediate layer and dried at 80° C. for 20 minutes, thus forming a charge generation layer having a thickness of 0.2 μm.

Next, 10 parts of a hydrazone compound and 10 parts of a polycarbonate Z resin (viscosity-average molecular weight: 20,000) employed as charge transfer materials, and expressed by the structural formula shown below, were dissolved in a mixed solvent of 60 parts of monochlorobenzene. This mixture was then dipped and applied onto the above-mentioned charge generation layer and dried at 120° C. for 60 minutes. Thus, a charge transfer layer having a thickness of 20 μm was manufactured.

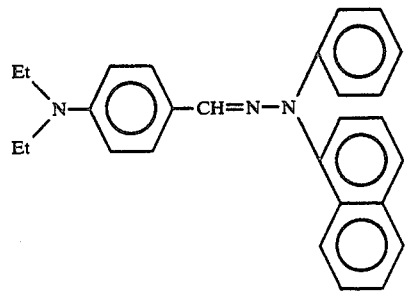

The photosensitive drum obtained in this way was mounted on the laser printer identified by the trade mark LBP-SX which is commercially available from Canon K.K. When this drum was evaluated for initial characteristics, durability characteristics and black spot fogs in different environments, that is, low temperature and low humidity (15° C., 10% RH)-L/L, normal temperature and normal humidity (23° C., 55% RH)-N/N and high temperature and high humidity (33° C., 85% RH)-H/H, excellent results were obtained. The results are shown in Table 2.

COMPARATIVE EXAMPLE 1

A photosensitive member was prepared in the same way as in Example 1 except that electroconductive titanium oxide powder coated with tin oxide containing 10% antimony was used as the electroconductive intermediate layer and evaluated. According to the results of this evaluation, the sensitivity decreased and residual potential increased. The results are shown in Table 1.

COMPARATIVE EXAMPLE 2

A photosensitive member was prepared in the same way as in Example 1 except that electroconductive titanium indium powder was used for the electroconductive intermediate layer and evaluated. According to the results of this evaluation, the sensitivity decreased and residual potential increased. The results are shown in Table 1.

COMPARATIVE EXAMPLE 3

A photosensitive member was prepared in the same way as in Example 8 except that electroconductive titanium oxide powder coated with tin oxide containing 10% antimony was used for the electroconductive intermediate layer and evaluated. According to the results of this evaluation, the sensitivity decreased and residual potential increased, and conspicuous black spot fogs occurred in the high temperature and high humidity environment. The results are shown in Table 2.

COMPARATIVE EXAMPLE 4

ITO in which tin oxide is present at 2%w/w) was vapor deposited on an aluminum sheet by an electron beam vapor deposition method in an oxygen atmosphere, thus forming an ITO deposition film having a thickness of 0.1 μm. Using this as a base, a photosensitive member was prepared and evaluated in the same way as in Example 8. According to the results of this evaluation, the surface resistance of the ITO deposition film could not sufficiently prevent charge implantation. Thus, dark attenuation was large and spot fog occurred even in a normal temperature and normal humidity environment. In addition, dark attenuation of the electrical potential was large and fog occurred on the entire surface of the image. The results are shown in Table 2.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the claims. The following claims are to be accorded a broad interpretation, so as to encompass all possible modifications and equivalent structures and functions.

TABLE 1

| | Sensitivity ($E\Delta_{500}$:μJ/cm²) 682 nm | 778 nm | Residual Electrical Potential (−V) |
|---|---|---|---|
| Example 1 | 0.85 | 0.70 | 25 |
| Example 2 | 0.80 | 0.65 | 20 |
| Example 3 | 0.65 | 0.53 | 10 |
| Example 7 | 0.60 | 0.65 | 27 |
| Comparative Example 1 | 0.95 | 0.82 | 30 |

TABLE 1-continued

| | Sensitivity ($E\Delta_{500}$:lux · sec) 540 nm | | Residual Electrical Potential (−V) |
|---|---|---|---|
| Comparative Example 2 | 1.25 | 1.11 | 78 |
| Example 4 | 5.3 | | 5 |
| Example 5 | 1.8 | | 3 |
| Example 6 | 3.5 | | 3 |

TABLE 2

| | Initial Characteristics (−V) L/L | N/N | H/H | Durability Characteristics (1,000 times) (V)[1] L/L | N/N | H/H | Black spot fog (H/H) evaluation |
|---|---|---|---|---|---|---|---|
| Example 8 | Vd = 700 | Vd = 700 | Vd = 700 | ΔVd = +5 | ΔVd = −10 | ΔVd = −20 | Excellent |
| | V1 = 230 | V1 = 205 | V1 = 195 | ΔV1 = +20 | ΔV1 = 0 | ΔV1 = −15 | |
| Comparative | Vd = 700 | Vd = 700 | Vd = 700 | ΔVd = +5 | ΔVd = +10 | ΔVd = −40 | Black spot fog |
| Example 3 | V1 = 240 | V1 = 220 | V1 = 190 | ΔV1 = +50 | ΔV1 = +35 | ΔV1 = −55 | occurred |
| Comparative | Vd = 700 | Vd = 700 | Vd = 600 | ΔVd = +10 | ΔVd = +15 | ΔVd = −100 | Fog occurred image |
| Example 4 | V1 = 200 | V1 = 210 | V1 = 150 | ΔV1 = +10 | ΔV1 = −25 | ΔV1 = −50 | quality is quite poor |

[1]: Vd = Vd(0) − Vd(1,000): ΔV1 = V1 (0) − V1(1,000)

What is claimed is:

1. An electrophotographic photosensitive member having a photosensitive layer on an electroconductive base, said member having at least one intermediate layer between the base and the photosensitive layer, said intermediate layer containing indium oxide - tin oxide solid solution (ITO) powder and a binder resin.

2. An electrophotographic photosensitive member according to claim 1, wherein the amount of the indium oxide in the ITO solid solution powder is from 99.5 wt % to 70 wt %.

3. An electrophotographic photosensitive member according to claim 1, wherein the amount of the ITO solid solution powder in the intermediate layer is from 33 wt % to 80 wt %.

4. An electrophotographic photosensitive member according to claim 1, wherein a resistivity value of the intermediate layer in an electric field intensity of $10^5$ V/m is from $10^{10}$.

5. An electrophotographic photosensitive member according to claim 1, wherein the thickness of the intermediate layer is from 3 μm to 30 μm.

6. An electrophotographic photosensitive member according to claim 1, wherein the photosensitive member is provided with a second intermediate layer containing a resin compound with ionic conductivity between the base and the photosensitive layer.

7. An electrophotographic photosensitive member according to claim 1, wherein titanyl phthalocyanine is contained in the photosensitive layer.

* * * * *

UNITED STATES PATENT AND TRADEMARK OFFICE

CERTIFICATE OF CORRECTION

PATENT NO. : 5,320,922

DATED : June 14, 1994

INVENTOR(S) : SHINYA MAYAMA, ET AL.

It is certified that error appears in the above-identified patent and that said Letters Patent is hereby corrected as shown below:

COLUMN 1

Line 53, "humidity" should read --humidity.--.
Line 58, "tion" should read --tion.--.
Line 63, "occurs" should read --occurs.--.

COLUMN 2

Line 3, "member;" should read --member,--.
Line 47, "resin" should read --resin.--.

COLUMN 4

Line 15, "nylon4," should read --nylon-4,--.
Line 27, "imide" should read --imido--.
Line 66, "layers" should read --layers.--.

COLUMN 5

Line 20, "resins" should read --resins.--.
Line 23, "anthantrone," should read --anthanthrone--.

COLUMN 7

Line 17, "5" should be deleted.
Line 35, "19" should read --19.--.
Line 38, "line 5" should read --line 15--.
Line 43, "recorded" should read --recorded.--.

COLUMN 8

Line 42, "means" should read --means of-- and close up right margin.

UNITED STATES PATENT AND TRADEMARK OFFICE

CERTIFICATE OF CORRECTION

PATENT NO. : 5,320,922

DATED : June 14, 1994

INVENTOR(S) : SHINYA MAYAMA, ET AL.

It is certified that error appears in the above-identified patent and that said Letters Patent is hereby corrected as shown below:

COLUMN 14

TABLE 2, "occurred" (second occurrence) should read --occurred,--.

Line 41, "$10^{10}$." should read --$10^{10}$ Ωcm to $10^{5}$ Ωcm.--.

Signed and Sealed this

Fifteenth Day of November, 1994

Bruce Lehman

*Attest:*

BRUCE LEHMAN

*Attesting Officer*

*Commissioner of Patents and Trademarks*